US007515857B2

(12) United States Patent
Takeyama

(10) Patent No.: US 7,515,857 B2
(45) Date of Patent: Apr. 7, 2009

(54) IMAGE FORMING APPARATUS

(75) Inventor: Yoshinobu Takeyama, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 164 days.

(21) Appl. No.: 11/637,172

(22) Filed: Dec. 12, 2006

(65) Prior Publication Data

US 2007/0183817 A1 Aug. 9, 2007

(30) Foreign Application Priority Data

Dec. 13, 2005 (JP) ..... 2005-359302

(51) Int. Cl.
*G03G 15/01* (2006.01)
*G03G 15/00* (2006.01)

(52) U.S. Cl. ..... 399/301; 399/49; 399/72

(58) Field of Classification Search ..... 399/49, 399/72, 301, 302, 303, 394, 395
See application file for complete search history.

(56) References Cited

U.S. PATENT DOCUMENTS 5,481,337 A 1/1996 Tsuchiya et al.
6,970,660 B2 * 11/2005 Harada et al. ..... 399/49
6,973,272 B2 * 12/2005 Yamamoto et al. ..... 399/15
2003/0210412 A1 11/2003 Ishibashi
2004/0239745 A1 12/2004 Takeyama et al.

FOREIGN PATENT DOCUMENTS

JP 06-253151 9/1994
JP 8-137351 5/1996
JP 2002-287527 10/2002
JP 2005-148127 6/2005

* cited by examiner

*Primary Examiner*—Hoang Ngo
(74) *Attorney, Agent, or Firm*—Harness, Dickey & Pierce, P.L.C.

(57) ABSTRACT

An image forming apparatus in which image warp and shift are able to be more precisely suppressed to prevent the deterioration of image quality, including a fluctuation amount detection device for detecting at a fixed cycle sampling point the belt fluctuation amount of an intermediate transfer body from a reference position in the direction orthogonal to the running direction of the intermediate transfer body or the main scanning direction, and a control unit which, in accordance with belt fluctuation amount data that expresses the belt fluctuation amount detected by the fluctuation amount detection device, corrects start position data that expresses the write start position data in the main scanning direction of the write device, and alters the fixed cycle sampling point when the amount of change in the belt fluctuation amount data in adjacent sampling points of the fixed cycle sampling points is greater than a value set in advance.

22 Claims, 6 Drawing Sheets

IMAGE FORMING APPARATUS

BACKGROUND OF THE INVENTION

1. Field of the Invention

The present invention relates to an image forming apparatus for forming a superposed image by writing an electrostatic latent image on an image carrier by scanning-type write means, forming a toner image by developing the electrostatic latent image using toner, and transferring the toner image to an intermediate transfer body, and more particularly relates to an image forming apparatus in which, during the running of the intermediate transfer body, when fluctuations occur in the direction orthogonal to the running direction, image distortion and shift are suppressed to prevent the deterioration of image quality.

2. Description of the Related Art

A known conventional image forming apparatus comprises a belt position detection means for detecting belt position in the direction orthogonal to the belt movement direction of an intermediate transfer belt, the belt slippage of the intermediate transfer belt being controlled by controlling the orientation of an adjustment roller in accordance with the belt position detected by belt position detection means (for example, see Japanese Unexamined Patent Application No. 2002-287527 (Prior Art 1).

Another known apparatus is an image forming substance removal device in which, by detection of the slippage of an offset belt by a sensor and the actuation of an actuator based on the result thereof, the position of one end of a tracking roller is changed to alter the position where contact of the offset belt supported by the tracking roller with a driving roller begins and correct the slippage of the offset belt. (For example, see Japanese Unexamined Patent Application No. H8-137351 (Prior Art 2).

However, in the image forming apparatus described in Prior Art 1, a small displacement of the intermediate transfer belt occurs even though the belt slippage is controlled and, accordingly, there is room for improvement in terms of suppressing the image warp and shift produced by this small displacement to prevent deterioration of image quality.

In addition, even thought the technology of the image forming substance removal device described in Prior Art 2 has application in an intermediate transfer belt, similarly to the image forming apparatus described in Japanese Unexamined Patent Application No. 2002-287527 (Prior Art 2) a small displacement of the intermediate transfer belt occurs and, accordingly, there is room for improvement in terms of suppressing the image warp and shift produced by this small displacement to prevent deterioration of image quality.

SUMMARY OF THE INVENTION

With the foregoing in view, it is an object of the present invention to provide an image forming apparatus in which image warp and shift are more precisely suppressed to prevent the deterioration of image quality. 12.

In accordance with the present invention, an image forming apparatus forms a superposed image by writing an electrostatic latent image on an image carrier by a scanning-type write device, forms a toner image by developing the electrostatic latent image using toner, and transfers the toner image to an intermediate transfer body. The image forming apparatus comprises a fluctuation amount detection device configured to detect the fluctuation amount of the intermediate transfer body from a reference position in the direction orthogonal to the running direction of the intermediate transfer body (hereinafter referred to as a main scanning direction); a start position data correction device configured to correct start position data that expresses the write start position in the main scanning direction of the write device in accordance with fluctuation amount data that expresses the fluctuation amount detected by the fluctuation amount detection device; and a detection position altering device configured to alter the predetermined detection position when the amount of change of the fluctuation amount data in adjacent detection positions of the predetermined detection position is larger than a predetermined value.

BRIEF DESCRIPTION OF THE DRAWINGS

The above and other objects, features and advances of the present invention will become more apparent from the following detailed description based on the accompanying drawings in which.

DESCRIPTION OF THE PREFERRED EMBODIMENTS

An embodiment of an image forming apparatus pertaining to the present invention will be hereinafter described with reference to the drawings.

Figure 1:
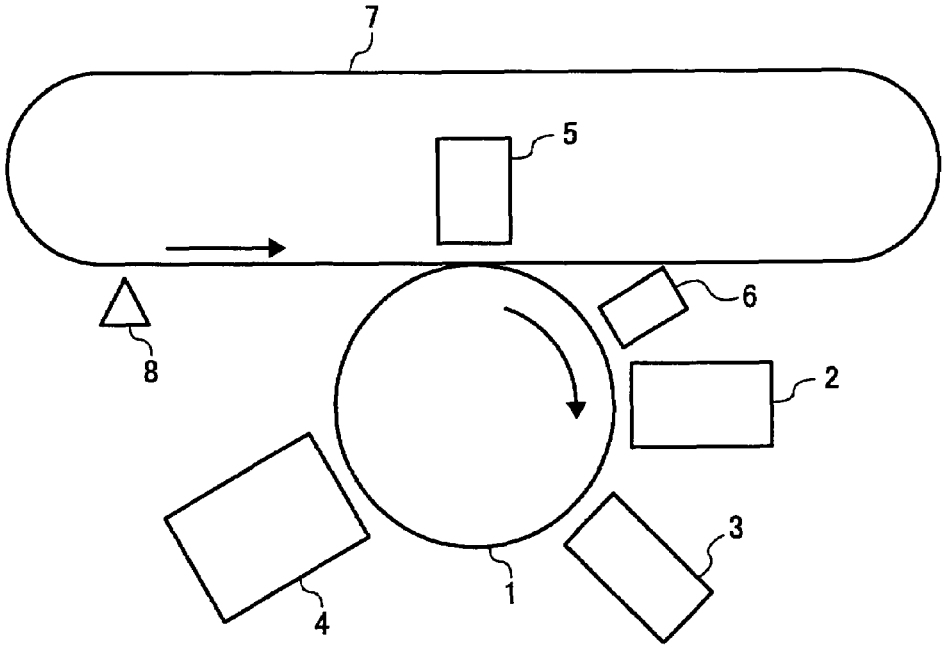
FIG. 1 is a diagram of the fundamental configuration of one embodiment of the image forming apparatus pertaining to the present invention.

FIG. 1 shows the fundamental configuration of one embodiment of an image forming apparatus pertaining to the present invention. This embodiment is explained using as an example an image forming apparatus for forming a color image based on the repetition of a step for forming an image on an image carrier by scanning-type write means and a step for transferring this image onto an intermediate transfer body a plurality of times for each different color, and the sequential superposing of these images for each color.

First, the configuration thereof will be explained.

As shown in FIG. 1, a charging means 2, write means 3, developing means 4, transfer means 5 and cleaning means 6 are arranged around an image carrier 1 serving as the body to be scanned. In addition, an intermediate transfer belt of a belt-like mode (hereinafter referred to also as a belt) 7 is arranged above the image carrier 1, the intermediate transfer body 7 comprising a belt mark that denotes a reference position for the start of image formation. In addition, a fluctuation amount detection means 8 for detecting the amount of belt fluctuation from the reference position in the direction orthogonal to the running direction of the intermediate transfer body 7 (hereinafter also referred to as the main scanning direction) is arranged below the intermediate transfer body 7.

The operation will be hereinafter summarily explained.

Charging means 2 charges the surface of the image carrier 1 rotating in the direction of the arrow shown in FIG. 1. When the belt mark of the intermediate transfer body 7 is detected, write means 3 initiates exposure in accordance with the image data and a latent image is formed on the image carrier 1. This latent image is developed as a toner image by developing means 4 and is transferred to the intermediate transfer body 7 by transfer means 5 at a contact point with the intermediate transfer body 7. Following transfer, cleaning means 6 cleans the residual transfer toner on the image carrier 1.

Thereupon, when a color (plurality of colors) image is to be formed, the step for development described above for different colors is repeated the number of times a color is required on the basis of the selection and so on of developing means by selection means not shown in the diagram, images of each color being superposed onto the intermediate transfer body 7. The images superposed onto the intermediate transfer body 7 are transferred onto and fixed on a recording medium such as paper by separate transfer means not shown in the diagram before being discharged outside the apparatus.

Thereupon, while the image formation of each color is initiated using the synchronization signal of write means 3 as a reference, when position displacement due to snaking of the belt 7 or side slippage or the like occurs, a shift and warp of the image occur.

In order to prevent deterioration of image quality caused by the occurrence of shift or warp of the image as described above, the image forming apparatus pertaining to the embodiment of the present invention determines the belt fluctuation (snaking, bias) amount from a reference position in the main scanning direction of the belt 7, and control the image forming timing of write means 3 in accordance with this belt fluctuation amount by means of a control unit not shown in the diagram. This is described in detail hereinafter with reference to FIGS. 2 to 4.

Figure 2:
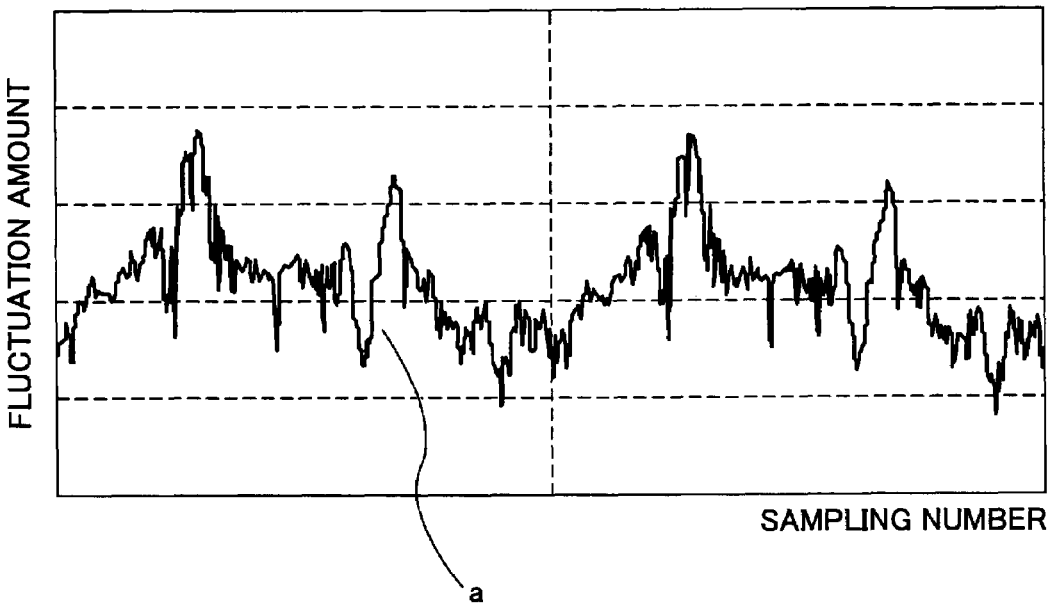
FIG. 2 is a graph depicting the belt fluctuation amount in two revolutions of a belt in a fixed cycle.
Figure 3:
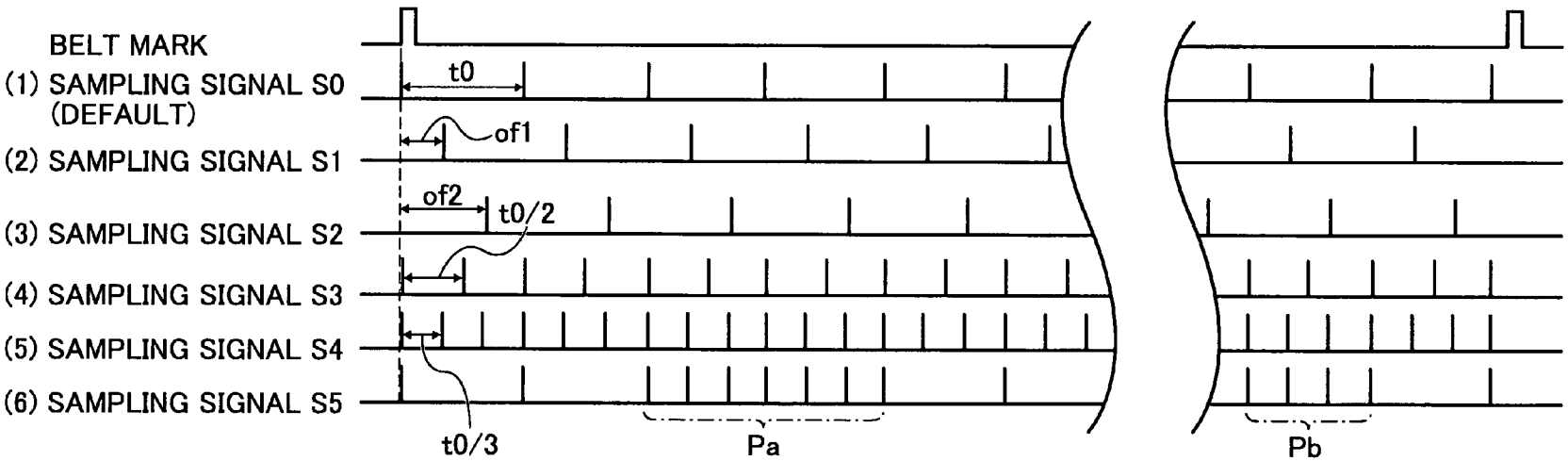
FIG. 3 is a timing chart showing the generated timing of sampling signals.
Figure 4A:
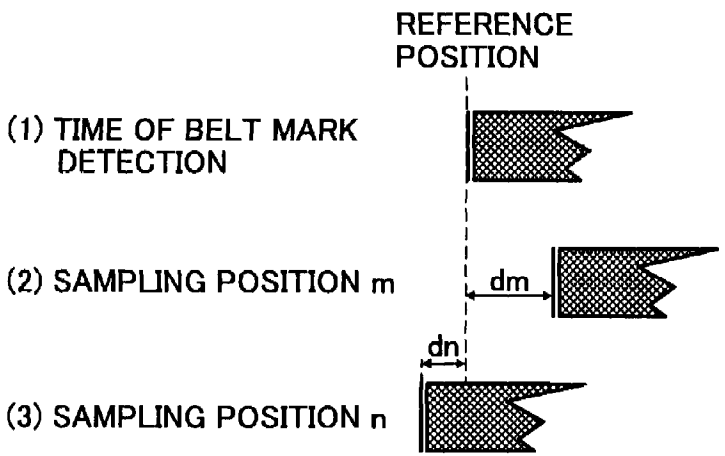
FIG. 4A is a diagram showing the belt fluctuation at sampling positions m and n.
Figure 4B:
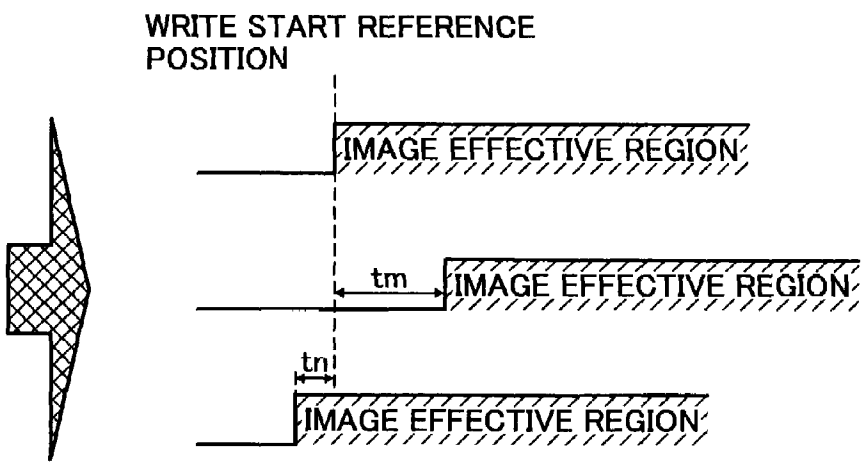
FIG. 4B is a diagram showing the write start timing.

FIG. 2 is a graph of the belt fluctuation amount in two revolutions of a belt in a fixed cycle. FIG. 3 is a timing chart showing the generated timing of sampling signals. FIG. 4A is a diagram showing the belt fluctuation at sampling positions m and n, and FIG. 4B is a diagram showing the write start timing.

It is clear from FIG. 2 that the fluctuations of the first revolution of the belt 7 are repeated in the second revolution thereof. The horizontal axis in FIG. 2 denotes the sampling number (position of detection of belt fluctuation amount) while the vertical axis denotes the belt fluctuation amount. Accordingly, the belt fluctuation amount (profile) data of the first belt revolution need only be determined, and for this belt fluctuation amount data to be employed by write means 3 to correct the start position data that expresses the write start position in the main scanning direction.

More specifically, while the fixing device or the like is warming up subsequent to the power source for the apparatus being switched ON, the control unit drives the belt 7 and fluctuation amount detection means 8 detects the belt fluctuation amount from the reference position in the main scanning direction of the belt 7 in a cycle established in advance.

Fluctuation amount detection means 8 detects (samples) the belt fluctuation amount at a sampling signal S0 (cycle t0) as shown in FIG. 3(1) using, for example, the belt mark provided in the belt 7 as a reference. A storage unit not shown in the diagram stores the belt fluctuation amount detected by fluctuation amount detection means 8 as belt fluctuation data.

When the amount of change in the belt fluctuation amount data between adjacent sampling points in the belt fluctuation amount data stored in the storage unit is greater than a value established in advance as shown by the "a" section of FIG. 2, fluctuation amount detection means 8 detects the belt fluctuation amount at a different position on the belt 7 to the sampling point determined using the sampling signal S0, and the storage unit adds this belt fluctuation amount as belt fluctuation amount data to the existing belt fluctuation amount data.

For example, fluctuation amount detection means 8 samples the belt fluctuation amount using sampling signals S1, S2 generated by a signal generating unit not shown in the diagram in which, as shown by (2) and (3) of FIG. 3, the offset time from a belt mark signal is altered to of1 and of2.

Moreover, fluctuation amount detection means 8 may sample the fluctuation amount using sampling signals S3, S4 generated by a signal generating unit in which, as shown by (4) and (5) of FIG. 3, the sampling cycle is taken as, for example, ½ and ⅓ of a cycle t0 set in advance.

In addition, fluctuation amount detection means 8 may sample the fluctuation amount using a sampling signal S5 generated by a signal generating unit in which, as shown in (6) of FIG. 3, the sampling period of only the required segment is shortened.

For example, as shown by the "a" section of FIG. 2, when the location at which the belt fluctuation amount changes significantly corresponds to a sampling period Pa and Pb of the sampling signal S5, the sampling number within this period is increased. FIG. 3 (6) illustrates the case of detection of the belt fluctuation amount using ⅓ of the sampling cycle of the period in question.

Moreover, fluctuation amount detection means 8 may sample the belt fluctuation amount based on a combining of the altering of the offset time, the use of ½ or ⅓ or the like of the cycle t0 and the shortening of the sampling period in a required segment as described above.

Employing the belt fluctuation data determined as described above, the start position data that expresses the write start position generated by write means 3 is corrected in the main scanning direction. Correction of the start position data involves altering the generated timing of the main scan image effective region signal (Lgate signal) to offset the fluctuation of the belt 7.

FIGS. 4A and 4B show examples thereof. These diagrams illustrate cases in which the belt fluctuation amount from the belt end face is determined.

The control unit performs control using the belt end face position at the time of belt mark detection (initial sampling point) as a reference position. More specifically, as shown in FIG. 4A, when the belt end face position is dm displaced in the belt center direction at the sampling position m of (2) or the belt end face position is dn displaced in the belt end face direction at the sampling position n of (3) with respect to the reference position of (1), the control unit, as shown in FIG. 4B, performs a control to delay the write start timing in the main scanning direction of the sampling position m by a time tm equivalent to the distance dm and to increase the write start timing in the main scanning direction of the sampling position n by a time tn equivalent to the distance dn. As a result, the write start positions of the image transferred onto the belt 7 can be matched in the main scanning direction.

The generated timing image effective region signal (Lgate signal) of the main scan will be hereinafter described in detail.

Figure 5:
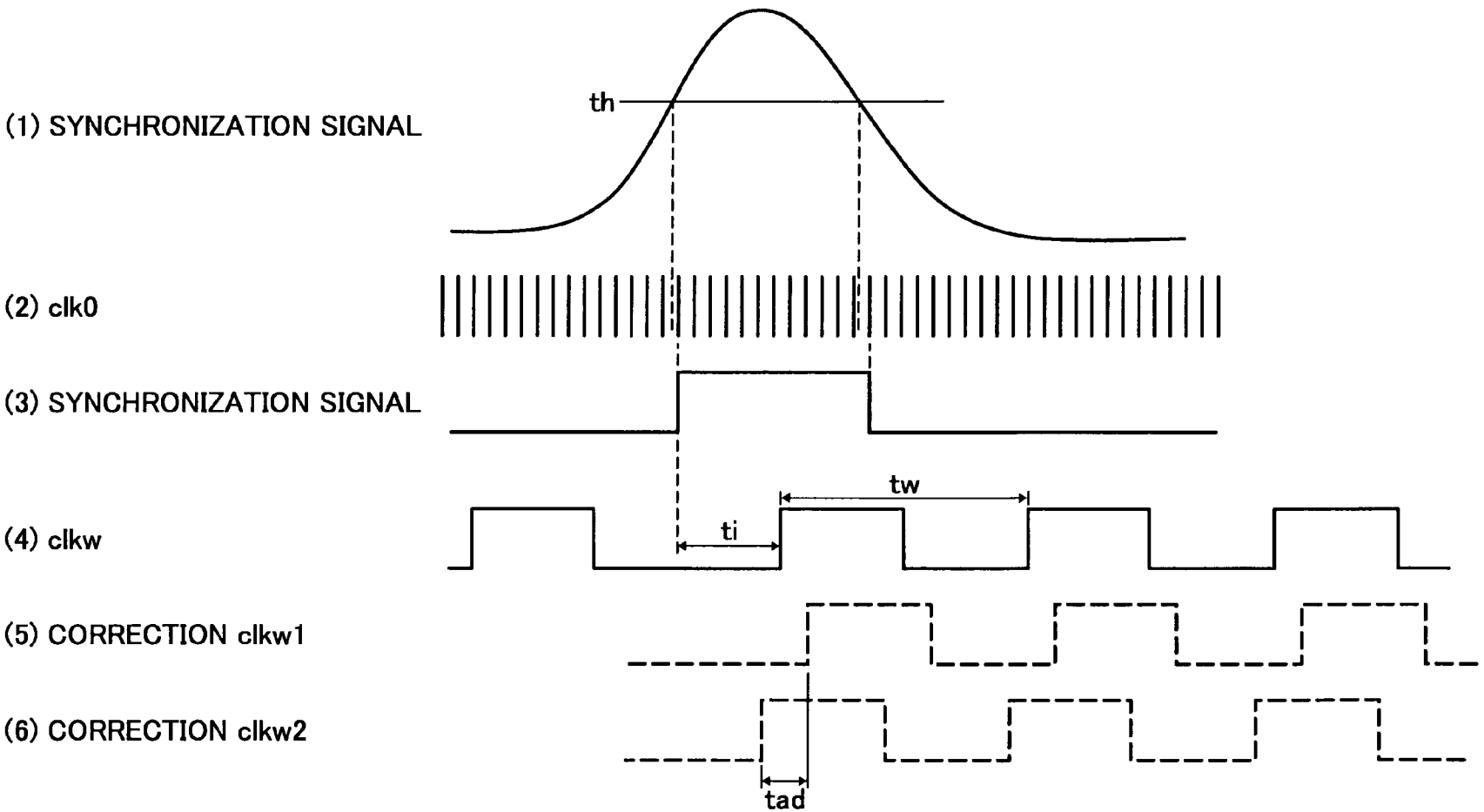
FIG. 5 is a timing chart of the generated timing of synchronization signals and pixel clocks.

FIG. 5 is a timing chart showing the generated timing of synchronization signals and pixel clocks. As shown in FIG. 5, when the synchronization detection signal generated by a synchronization sensor not shown in the diagram as a result of exposure to a scanning beam of write means 3 reaches a set reference value th it is latched by a source clock clk0 (cycle tg) that serves as a foundation for the basic clock for various control signals within the apparatus. More particularly, when the synchronization detection signal intersects the reference value th it is latched on the immediately following rising edge of the source clock clk0. This constitutes the synchronization signal (3) of FIG. 5 and, in this embodiment, when the synchronization detection signal is larger than the reference value th the synchronization signal H is formed, and when it is lower than the reference value th the synchronization signal L is formed.

When a synchronization signal is generated a predetermined number k set in advance of the source clock clk0 from the rising edge of the synchronization signal is counted, and a pixel clock clkw of a fixed cycle (cycle tw) with an initial period phase difference from the rising edge of the synchronization signal (time difference ti) and which serves as the basic clock of write means 3 is generated.

Here, while not shown in the diagram, the Lgate signal that denotes the image effective region of the main scan is generated counting a predetermined number j of the pixel clock clkw following generation of the synchronization signal.

Accordingly, in this case, a time tlo from when the synchronization signal is generated until the Lgate signal is generated is expressed by Equation (1) below.

$$tl0=ti+j*tw=k*tg+j*tw \quad \text{Equation (1)}$$

While FIG. 5 shows no great difference between the synchronization signal pulse width and the pixel clock cycle, this is for the purpose of simplifying the description thereof and, in reality, the synchronization signal pulse width is significantly larger.

In this embodiment the generated timing of the Lgate signal is changed to offset the fluctuation of the belt 7 as a result of altering the time from when the synchronization signal is generated until the pixel clock clkw is generated (offset value).

More specifically, when the pixel clock in the belt reference position (at the time of belt mark detection) is taken as clkw (initial stage phase difference ti) of (4) of FIG. 5, the count number of the source clock clk 0 is altered from the rising edge of the synchronization signal and set in accordance with the belt fluctuation amount of the belt reference position and the belt fluctuation amount of the sampling points and, for example, as shown by the dotted lines of (5) and (6), the pixel clock clkw and correction pixel clocks clkw1 and clkw2 of different initial stage phase difference are generated.

Thereupon, when the belt displacement dm in the sampling position m shown in FIGS. 4A and 4B is corrected, the count value of the source clock is taken as km, and the count value km is set to an integer that best satisfies equation (2) below.

$$km*tg-k*tg=tm \quad \text{Equation (2)}$$

In addition, when the belt displacement dn in the sampling position n shown in FIGS. 4A and 4B is corrected, the count value of the source clock is taken as kn, and the count value kn is set to an integer that best satisfies equation (3) below.

$$k*tg-kn*tg=tn \quad \text{Equation (3)}$$

The initial stage phase difference with respect to the pixel clock synchronization signals is changed as shown by the dotted lines of (5) and (6) of FIG. 5 by altering the setting of the count value of the source clock clk0 as described above.

Thereupon, a variable width count value s is provided so that the width of change of the initial period phase difference (difference in initial stage phase difference between clkw1 and clkw2) tad satisfies equation (4) noted below.

$$tad=s*tg\leqq tw \quad \text{Equation (4)}$$

In addition, when an initial stage phase difference larger than tw is required, the count number j of the pixel clock clkw should be altered until an Lgate signal is generated.

According to the image forming apparatus pertaining to the embodiment of the present invention described above, when the amount of change of the belt fluctuation amount data in adjacent sampling points of sampling points of a fixed cycle is greater than a value set in advance, because the sampling points are altered, the belt fluctuation of the belt 7 from the reference position in the main scanning direction can be finely detected, and the image warp and shift can be more precisely suppressed to ensure deterioration of image quality is prevented.

In addition, because the sampling point is altered as a result of the generation of a sampling signal in which the offset time from the belt mark signal is altered, correction of start position data can be more easily and precisely performed. In addition, because the sampling point is altered as a result of the shortening of the sampling cycle, the correction of start position data can be more easily and precisely performed. In addition, because the sampling point is altered by a shortening of the sampling cycle in the required segment alone, the correction of start position data can be more easily and precisely performed without unnecessarily increasing the belt fluctuation amount data.

Furthermore, because the write timing can be controlled by simply altering the time from when a synchronization signal is generated until the pixel clock clkw is generated, the image shift amount can be finely decreased by means of a simple control.

Moreover, when the belt fluctuation amount from the belt end face such as described above is to be determined, the effect produced by the shape of the belt end face on the correction of start position data may be eliminated by determining the difference thereof employing two fluctuation amount detection means 8. In addition, the belt fluctuation amount may be determined by a method other than those described above based on a determining of the belt fluctuation amount from a detection mark provided in a belt 7.

In addition, while improvements in densification of image forming apparatus have occurred in recent years, the detection and retention of the fluctuation amount in a density corresponding to the image density is impractical. Thereupon, the belt fluctuation amount at belt positions other than at the sampling points may be determined by the control unit from belt fluctuation amount data nearest to the belt position being analyzed. That is to say, the belt fluctuation amount data nearest to (front and back) the belt position being analyzed is assumed to have been linearly displaced, and the control unit corrects the start position data based on a calculation of the belt fluctuation amount of the belt position being analyzed.

In addition, as is described earlier, when the amount of change in the belt fluctuation amount data of the adjacent sampling points of the belt fluctuation amount data recorded in the storage unit is greater than a value set in advance, because the belt fluctuation amount is determined on the basis of a reduction of the sampling point interval until the amount of change is the same or less than a value set in advance, the belt fluctuation amount between sampling points is linearly approximated.

Figure 6:
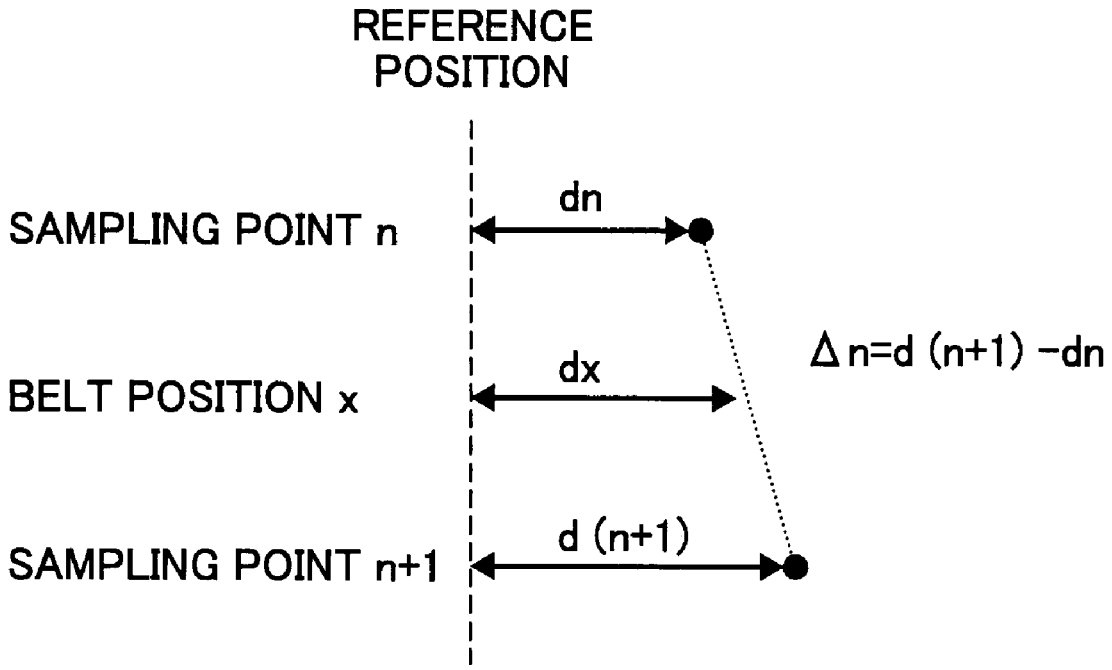
FIG. 6 is a diagram for explaining the calculation of the belt fluctuation amount at an arbitrary belt position located between adjacent sampling points.

Referring to FIG. 6, the calculation of the belt fluctuation amount at an arbitrary belt position located between adjacent sampling points will be described.

When a displacement amount Δn of a sampling point n+1 from a sampling point n is equivalent to a displacement difference Δd0 or less set in advance, the line that links the sampling point n to the sampling point n+1 in a straight line as shown in FIG. 6 is taken as the belt fluctuation amount of the arbitrary belt position between the sampling point n and the sampling point n+1. Accordingly, the belt fluctuation amount of a belt position x is determined as dx, and the start position data can be corrected employing this belt fluctuation amount.

In addition, when the displacement amount Δn between the adjacent sampling point n and sampling n+1 is larger than a displacement difference Δd0 set in advance, the sampling point is increased so that the Δn is the same or less than Δd0. The belt fluctuation amount is determined as described above at the point that Δn is the same or less than Δd0, and the start position data are corrected employing this belt fluctuation amount.

The displacement difference Δd0 set in advance is set to an appropriate value with consideration of, for example, the sampling cycle, the image density and the image print speed. In addition, the belt fluctuation amount of an arbitrary belt position detected by fluctuation amount detection means 8 or calculated from a fluctuation amount determined by approximation as described above is continuously employed to the next sampling point or to the belt position determined by approximation as described above.

By adoption of a configuration such as this, the belt fluctuation amount data of the belt 7 other than at a sampling point is calculated in accordance with belt fluctuation amount data that expresses detected belt fluctuation amount and, accordingly, even when the amount of belt fluctuation amount data of a sampling point is small, correction of the start position data can be implemented easily and precisely.

In addition, a rigid execution of the correction of the start position data with respect to the belt fluctuation amount ideally involves a correction being performed on each line (scan). Accompanying the increase in speed of image forming apparatuses that has occurred in recent years, detection of the belt fluctuation amount in real time for each line and correction of start position data from this belt fluctuation amount in a single scanning period, as well as employment of a sensor of large pixel number such as a linear image sensor as fluctuation amount detection means 8 and so on, has become difficult. Thereupon, a control for correcting start position data on each line (scan) based on a belt fluctuation amount detected in advance and a predicted fluctuation amount determined by approximation from the belt fluctuation amount is performed.

The predicted fluctuation amount can be obtained by linear approximation as described above employing the belt fluctuation amount data set in advance. In addition, the correction of the start position data involves setting of start position data in a pixel clock the setting part shown in the diagram by the time the synchronization detection signal of the next line is generated.

By adoption of a configuration such as this, belt fluctuation amount data for positions of the belt 7 corresponding to all lines is able to be obtained and, accordingly, even when high-speed writing is required, the correction of start position data can be easily and precisely performed.

In addition, as shown in FIG. 3, the fluctuation of the belt 7 is repeated in each revolution of the belt. If the belt fluctuation is repeated the need for detection in real time is eliminated and detection need only be performed prior to image formation. In addition, so long as the belt fluctuation amount has been detected once and retained as belt fluctuation amount data, the start position data can be calculated.

Thereupon, while the fixing device or the like is warming up subsequent to the power source for the apparatus being switched ON, the control unit drives the belt 7, fluctuation amount detection means 8 detects the belt fluctuation amount, and the belt fluctuation amount is stored as belt fluctuation amount data by the storage unit.

However the belt fluctuation amount changes over time due to, for example, temperature changes and humidity changes in the image forming apparatus and the effect of the load during image formation.

For example, an overall gradual bias (the belt end face direction) in the belt 7 in either direction (in FIG. 2, where the fluctuation waveform has shifted in either the up or down direction) or change in the fluctuation waveform sometimes occurs. Accordingly, fluctuation amount detection means 8 redetects the belt fluctuation amount not only at times when the power source for the apparatus is switched ON but also at times when conditions set in advance are fulfilled, whereupon the storage unit stores the detected belt fluctuation amount as belt fluctuation amount data and updates the belt fluctuation amount data.

The conditions for redetection of the belt fluctuation amount in this embodiment are when a print number set in advance is reached, when the elapsed time from the switching ON of the power source reaches a predetermined time, and when the change in humidity from the humidity when the fluctuation amount is detected is outside a predetermined range.

By adoption of this kind of configuration, warp and shift of the image can be more precisely suppressed to prevent deterioration of image quality in the absence of the effects of changes over time.

Figure 7:
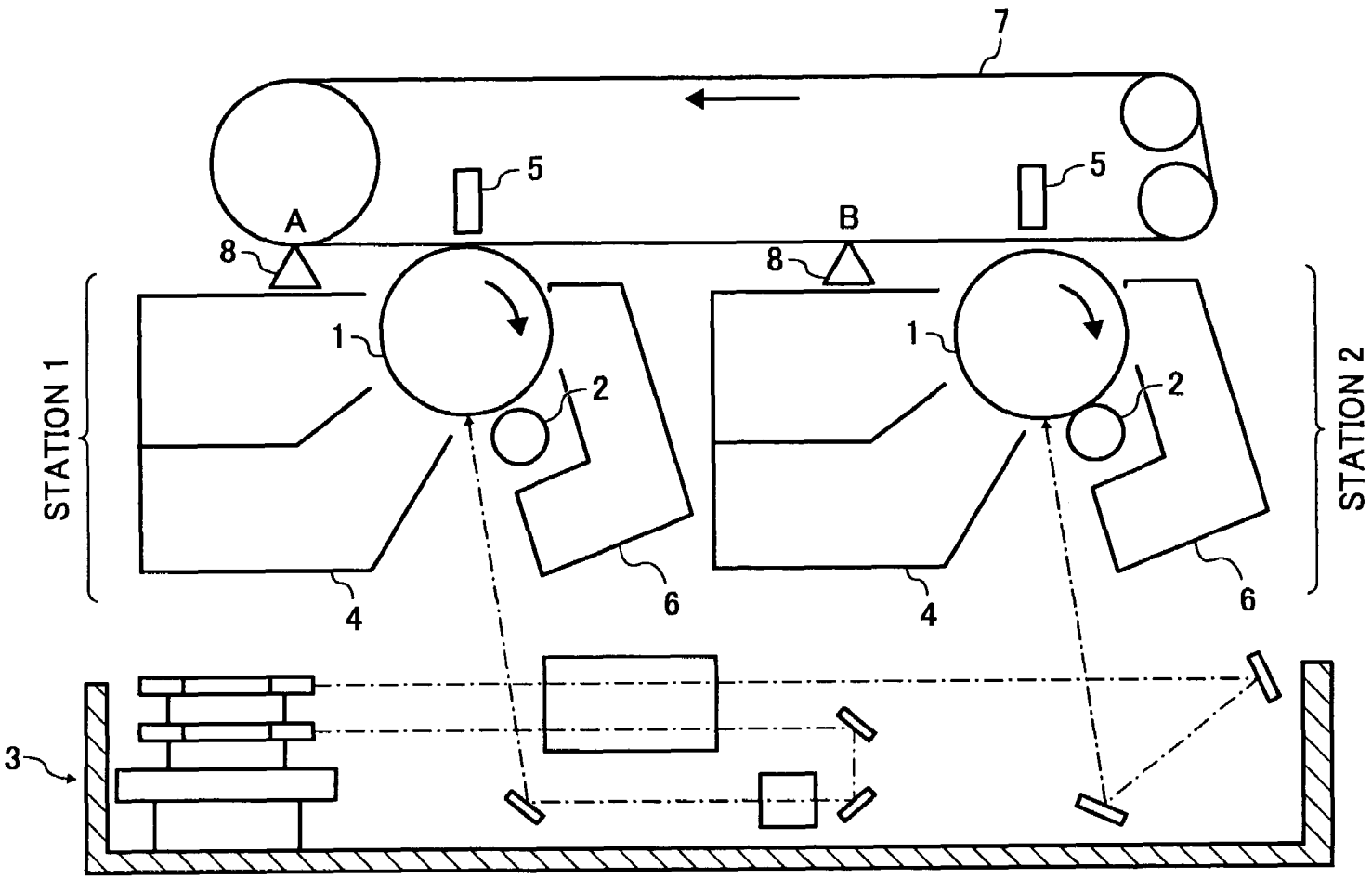
FIG. 7 is a diagram showing the schematic configuration of a 2-station image forming apparatus pertaining to this embodiment.

In addition, the image forming apparatus pertaining to this embodiment may constitute a 2-station configuration. FIG. 7 is a schematic block diagram of the 2-station image forming apparatus. Identical symbols have been assigned to constituent elements thereof identical to those of FIG. 1.

As shown in FIG. 7, the image forming apparatus comprises two image forming means provided below the intermediate transfer body 7 (station 1, station 2). Each image forming means is configured from one image carrier 1, one write means 3, two developing means 4 for developing the electrostatic latent image formed by write means 3 on the image carrier 1, and selection means not shown in the diagram for alternatively and selectively driving developing means 4, an image of a plurality of colors being generated by superposing of images formed by a plurality of image forming means on the intermediate transfer body 7. Moreover, each image forming means may comprise three or more developing means 4.

Taking the belt position (point) at which fluctuation amount detection means 8 corresponding to station 1 detects the belt fluctuation amount as sampling position A and the belt position (point) at which fluctuation amount detection means 8 corresponding to station 2 detects the belt fluctuation amount as sampling position B, the belt fluctuation (waveform) detected at sampling position A is detected to be essentially identical to that at sampling position B after the time required for the belt 7 to move from sampling position A to sampling position B has elapsed.

However, when the movement time between sampling points is delayed due to the effect of irregularities in belt speed that, in reality, occur even when the belt 7 is ideally driven, these fluctuations are not always exactly the same.

Thereupon, as shown in FIG. 7, fluctuation amount detection means 8 are provided corresponding to each image forming means (station 1, station 2).

By adoption of this kind of configuration, image shift can be more precisely suppressed. In addition, a compact high-speed image forming apparatus can be configured.

As is described above, the present invention provides an image forming apparatus in which the warp and shift of the image can be precisely suppressed to prevent deterioration of image quality.

Various modifications will become possible for those skilled in the art after receiving the teachings of the present disclosure without departing from the scope thereof.

What is claimed is:

1. An image forming apparatus for forming a superposed image by writing an electrostatic latent image on an image carrier by scanning-type write means, forming a toner image by developing said electrostatic latent image using toner, and transferring said toner image to an intermediate transfer body, comprising:

fluctuation amount detection means for detecting the fluctuation amount of said intermediate transfer body from a reference position in the direction orthogonal to the running direction of said intermediate transfer body (hereinafter referred to as a main scanning direction);

start position data correction means for correcting start position data that expresses the write start position in the main scanning direction of said write means in accordance with fluctuation amount data that expresses the fluctuation amount detected by said fluctuation amount detection means; and detection position altering means for altering said predetermined detection position when the amount of change of the fluctuation amount data in adjacent detection positions of said predetermined detection position is larger than a predetermined value.

2. The image forming apparatus as claimed in claim 1, wherein said fluctuation amount detection means detects said fluctuation amount in a predetermined cycle, and said detection position altering means alters the detection position where detection by said fluctuation amount detection means is started.

3. The image forming apparatus as claimed in claim 1, wherein said fluctuation amount detection means detects said fluctuation amount in a predetermined cycle, and said detection position altering means shortens said cycle.

4. The image forming apparatus as claimed in claim 1, wherein said fluctuation amount detection means detects said fluctuation amount in a predetermined cycle, and said detection position altering means shortens said cycle only in segments where the amount of change of the fluctuation amount data in adjacent detection positions of said predetermined detection position is larger than a predetermined value.

5. The image forming apparatus as claimed in claim 1, wherein said start position data correction means alters an offset value from when a synchronization signal is generated by a scanning beam of said write means to when a pixel clock is generated, in accordance with fluctuation amount data that expresses the fluctuation amount detected by said fluctuation amount detection means.

6. The image forming apparatus as claimed in claim 1, further comprising fluctuation amount data calculation means for calculating fluctuation amount data at positions of said intermediate transfer body other than the detection position detected by said fluctuation amount detection means, in accordance with fluctuation amount data that expresses the fluctuation amount detected by said fluctuation amount detection means, wherein said start position data correction means corrects said station position data in accordance with fluctuation amount data that expresses the fluctuation amount detected by said fluctuation amount detection means and fluctuation amount data obtained by calculation by said fluctuation amount data calculation means.

7. The image forming apparatus as claimed in claim 6, wherein said fluctuation amount data calculation means calculates fluctuation amount data at positions of said intermediate transfer body other than the detection position detected by said fluctuation amount detection means of the positions of said intermediate transfer body corresponding to all lines written by said write means.

8. The image forming apparatus as claimed in claim 1, wherein said fluctuation amount detection means detects said fluctuation amount when the power source for said image forming apparatus is switched ON or when conditions related to changes over time of the image forming apparatus are satisfied.

9. The image forming apparatus as claimed in claim 1, further comprising a plurality of image forming means for forming images, wherein said plurality of image forming means each comprise said fluctuation amount detection means.

10. The image forming apparatus as claimed in claim 1, further comprising a plurality of image forming means arranged opposing a moving surface of said intermediate transfer body, wherein said plurality of image forming means each comprise one said image carrier, one said write means, a plurality of developing means for developing said electrostatic latent image using toner, and selection means for selecting one developing means from said plurality of developing means.

11. The image forming apparatus as claimed in claim 9, wherein said plurality of image forming means are each arranged opposing a moving surface of said intermediate transfer body, and comprise one said image carrier, one said write means, a plurality of developing means for developing said electrostatic latent image using toner, and selection means for selecting one developing means from said plurality of developing means.

12. An image forming apparatus for forming a superposed image by writing an electrostatic latent image on an image carrier by a scanning-type write device, forming a toner image by developing said electrostatic latent image using toner, and transferring said toner image to an intermediate transfer body, comprising:

a fluctuation amount detection device configured to detect the fluctuation amount of said intermediate transfer body from a reference position in the direction orthogonal to the running direction of said intermediate transfer body (hereinafter referred to as a main scanning direction);

a start position data correction device configured to correct start position data that expresses the write start position in the main scanning direction of said write device in accordance with fluctuation amount data that expresses the fluctuation amount detected by said fluctuation amount detection device; and a detection position altering device configured to alter said predetermined detection position when the amount of change of the fluctuation amount data in adjacent detection positions of said predetermined detection position is larger than a predetermined value.

13. The image forming apparatus as claimed in claim 12, wherein said fluctuation amount detection device detects said fluctuation amount in a predetermined cycle, and said detection position altering device alters the detection position where detection by said fluctuation amount detection device is started.

14. The image forming apparatus as claimed in claim 12, wherein said fluctuation amount detection device detects said fluctuation amount in a predetermined cycle, and said detection position altering device shortens said cycle.

15. The image forming apparatus as claimed in claim 13, wherein said fluctuation amount detection device detects said fluctuation amount in a predetermined cycle, and said detection position altering device shortens said cycle only in segments where the amount of change of the fluctuation amount data in adjacent detection positions of said predetermined detection position is larger than a predetermined value.

16. The image forming apparatus as claimed in claim 13, wherein said start position data correction device alters an offset value from when a synchronization signal is generated by a scanning beam of said write device to when a pixel clock is generated, in accordance with fluctuation amount data that expresses the fluctuation amount detected by said fluctuation amount detection device.

17. The image forming apparatus as claimed in claim 13, further comprising a fluctuation amount data calculation device configured to calculate fluctuation amount data at positions of said intermediate transfer body other than the detection position detected by said fluctuation amount detection device, in accordance with fluctuation amount data that expresses the fluctuation amount detected by said fluctuation amount detection device, wherein said start position data correction device corrects said station position data in accordance with fluctuation amount data that expresses the fluctuation amount detected by said fluctuation amount detection device and fluctuation amount data obtained by calculation by said fluctuation amount data calculation device.

18. The image forming apparatus as claimed in claim 6, wherein said fluctuation amount data calculation device calculates fluctuation amount data at positions of said intermediate transfer body other than the detection position detected by said fluctuation amount detection device of the positions of said intermediate transfer body corresponding to all lines written by said write device.

19. The image forming apparatus as claimed in claim 12, wherein said fluctuation amount detection device detects said fluctuation amount when the power source for said image forming apparatus is switched ON or when conditions related to changes over time of the image forming apparatus are satisfied.

20. The image forming apparatus as claimed in claim 1, further comprising a plurality of image forming devices for forming images, wherein said plurality of image forming devices comprise said fluctuation amount detection device.

21. The image forming apparatus as claimed in claim 12, further comprising a plurality of image forming devices arranged opposing a moving surface of said intermediate transfer body, wherein said plurality of image forming devices each comprise one said image carrier, one said write device, a plurality of developing device configured to develop said electrostatic latent image using toner, and a selection device configured to select one developing device from said plurality of developing device.

22. The image forming apparatus as claimed in claim 20, wherein said plurality of image forming device are each arranged opposing a moving surface of said intermediate transfer body, and comprise one said image carrier, one said write device, a plurality of developing device for developing said electrostatic latent image using toner, and a selection device configured to select one developing device from said plurality of developing device.

* * * * *